US007171705B1

(12) United States Patent
Hicks

(10) Patent No.: US 7,171,705 B1
(45) Date of Patent: Feb. 6, 2007

(54) BATHTUB RAILING ASSEMBLY

(76) Inventor: Timothy S. Hicks, 525 University Ave. South East, Apartment #202, Minneapolis, MN (US) 55414

( * ) Notice: Subject to any disclaimer, the term of this patent is extended or adjusted under 35 U.S.C. 154(b) by 301 days.

(21) Appl. No.: 10/853,053

(22) Filed: May 26, 2004

(51) Int. Cl.
*A47K 3/024* (2006.01)

(52) U.S. Cl. ..... 4/576.1; 4/610; 292/262

(58) Field of Classification Search ..... 4/576.1, 4/610; 211/105.1; 160/349.2; 49/449; 292/262
See application file for complete search history.

(56) References Cited

U.S. PATENT DOCUMENTS

| | | | | |
|---|---|---|---|---|
| 2,059,171 | A | 10/1936 | Harris | 4/576.1 |
| 2,817,095 | A | 12/1957 | Jeffries | 4/576.1 |
| 3,228,038 | A | 1/1966 | Augustine | 4/576.1 |
| 3,328,920 | A * | 7/1967 | Cohen et al. | 292/262 X |
| 4,295,676 | A * | 10/1981 | Smith | 292/262 |
| 4,361,914 | A * | 12/1982 | Oliver | 4/610 X |
| 4,908,906 | A | 3/1990 | Hanna | 4/576.1 X |
| 5,329,651 | A | 7/1994 | Mardero et al. | 4/605 |
| 6,131,213 | A | 10/2000 | Sarff | 4/576.1 |
| D443,685 | S | 6/2001 | Gottwald | 423/111 |
| 6,381,771 | B1 | 5/2002 | Kelly | 4/576.1 |
| 6,507,960 | B1 | 1/2003 | Kelly | 4/576.1 |

* cited by examiner

*Primary Examiner*—Robert M. Fetsuga

(57) ABSTRACT

A bathtub railing assembly includes a bracket that is attached to a first wall and is positioned over and adjacent to a bathtub that is positioned between the first wall and a second wall. An elongated rod has a first end and a second end. The first end is pivotally coupled to the bracket so that the rod may be selectively positioned in a vertical position or a horizontal position. The second end of the rod is positioned adjacent to the second wall when the rod is in the horizontal position.

7 Claims, 3 Drawing Sheets

BATHTUB RAILING ASSEMBLY

BACKGROUND OF THE INVENTION

1. Field of the Invention

The present invention relates to bathtub railing devices and more particularly pertains to a new bathtub railing device for selectively providing a railing for a bathtub.

2. Description of the Prior Art

The use of bathtub railing devices is known in the prior art. U.S. Pat. No. 6,381,771 describes a railing assembly that may be attached between a pair of spaced wall for providing a hand railing. This assembly includes brackets that allow the railing to be selectively adjusted for height and removed as needed. Another type of bathtub railing device is U.S. Pat. No. 2,059,171 having a handle that is pivotally coupled to a wall for providing handhold for person within a bathtub. Yet another handhold assembly is shown in U.S. Pat. No. 4,908,906 which again is pivotally couplable to a wall for providing a handhold as needed.

While these devices fulfill their respective, particular objectives and requirements, the need remains for a device that serves as a railing that is positioned along a length of bathtub. The device should be able to be retrofitted to existing bathtubs and should also be adapted for being selectively positioned in a stored position or a horizontal position.

SUMMARY OF THE INVENTION

The present invention meets the needs presented above by generally comprising a bracket that is attached to a first wall and is positioned over and adjacent to a bathtub that is positioned between the first wall and a second wall. An elongated rod has a first end and a second end. The first end is pivotally coupled to the bracket so that the rod may be selectively positioned in a vertical position or a horizontal position. The second end of the rod is positioned adjacent to the second wall when the rod is in the horizontal position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
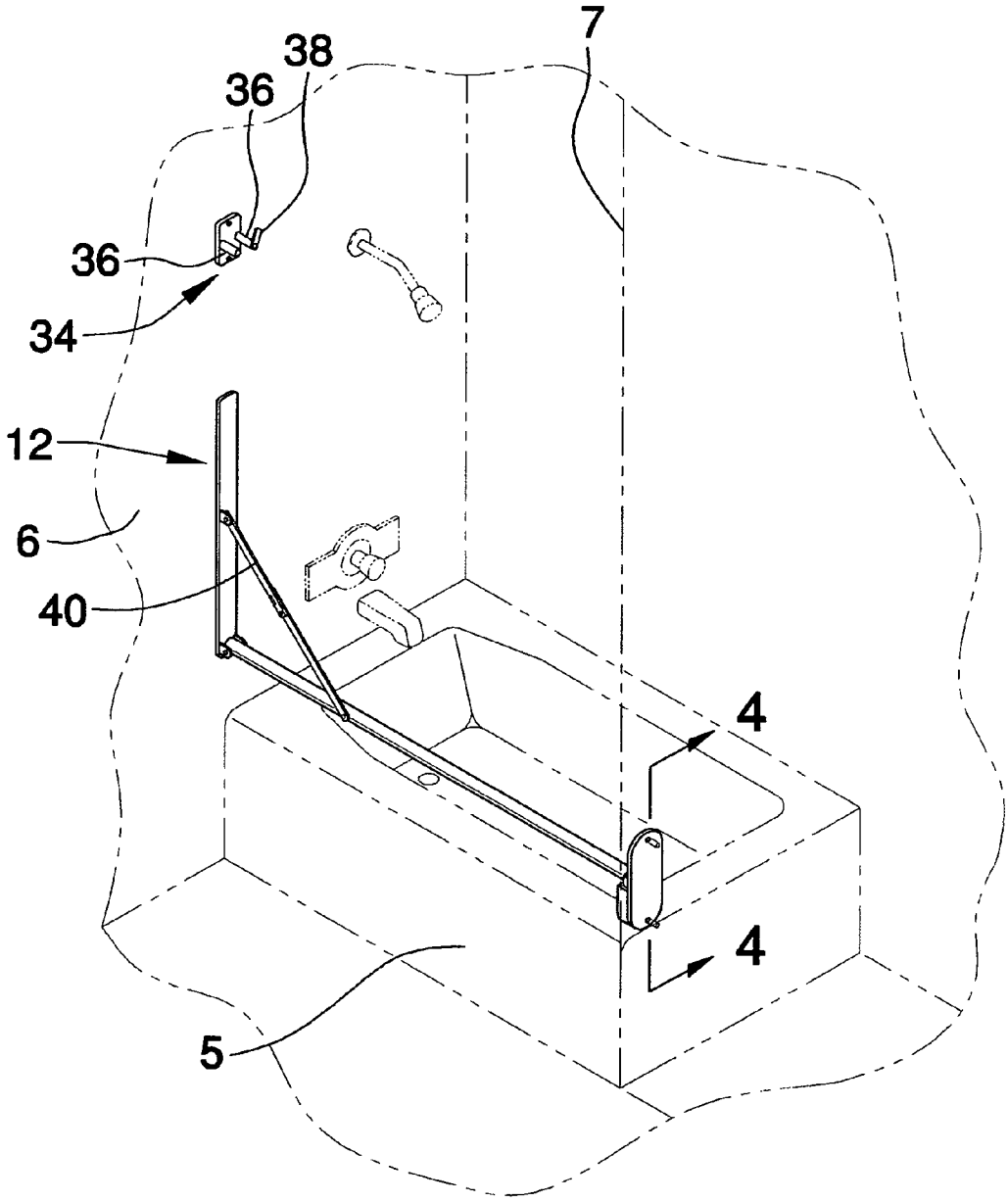
FIG. 1 is a perspective view of a bathtub railing assembly according to the present invention.
Figure 2:
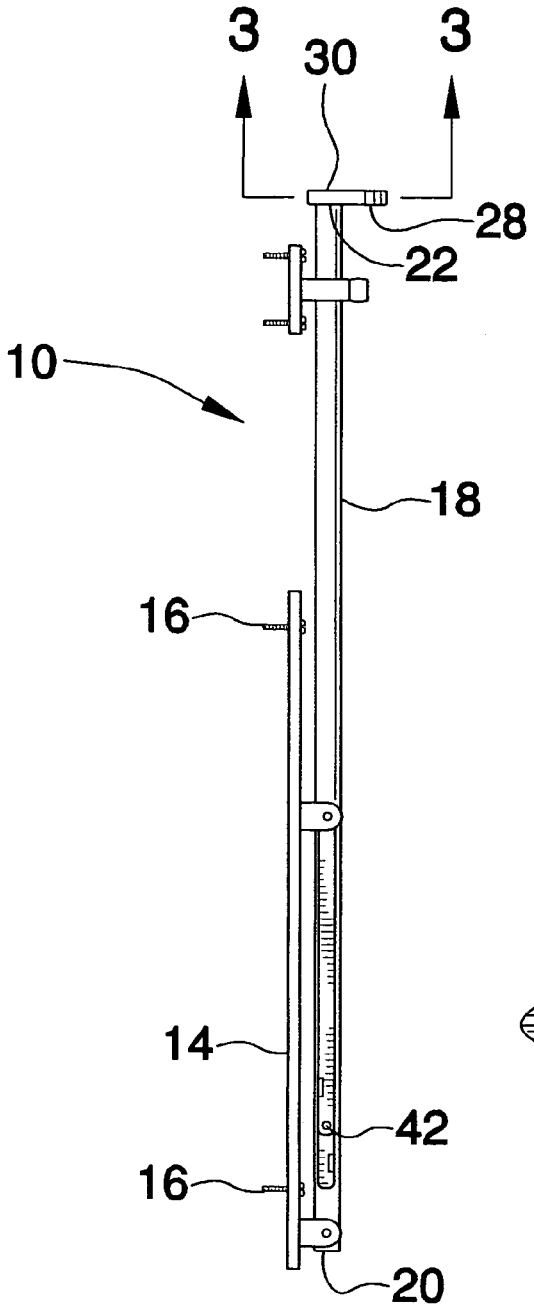
FIG. 2 is a side view of the present invention.
Figure 3:
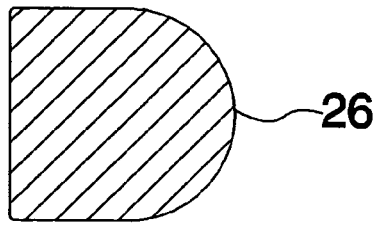
FIG. 3 is a cross-sectional view taken along line 3—3 of FIG. 2 of the present invention.
Figure 4:
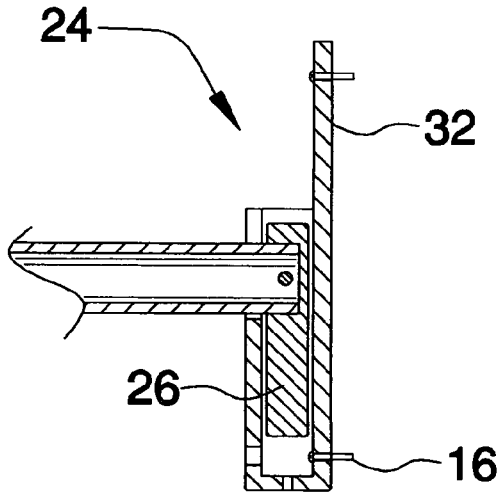
FIG. 4 is a cross-sectional view taken along line 4—4 of FIG. 1 of the present invention.
Figure 5:
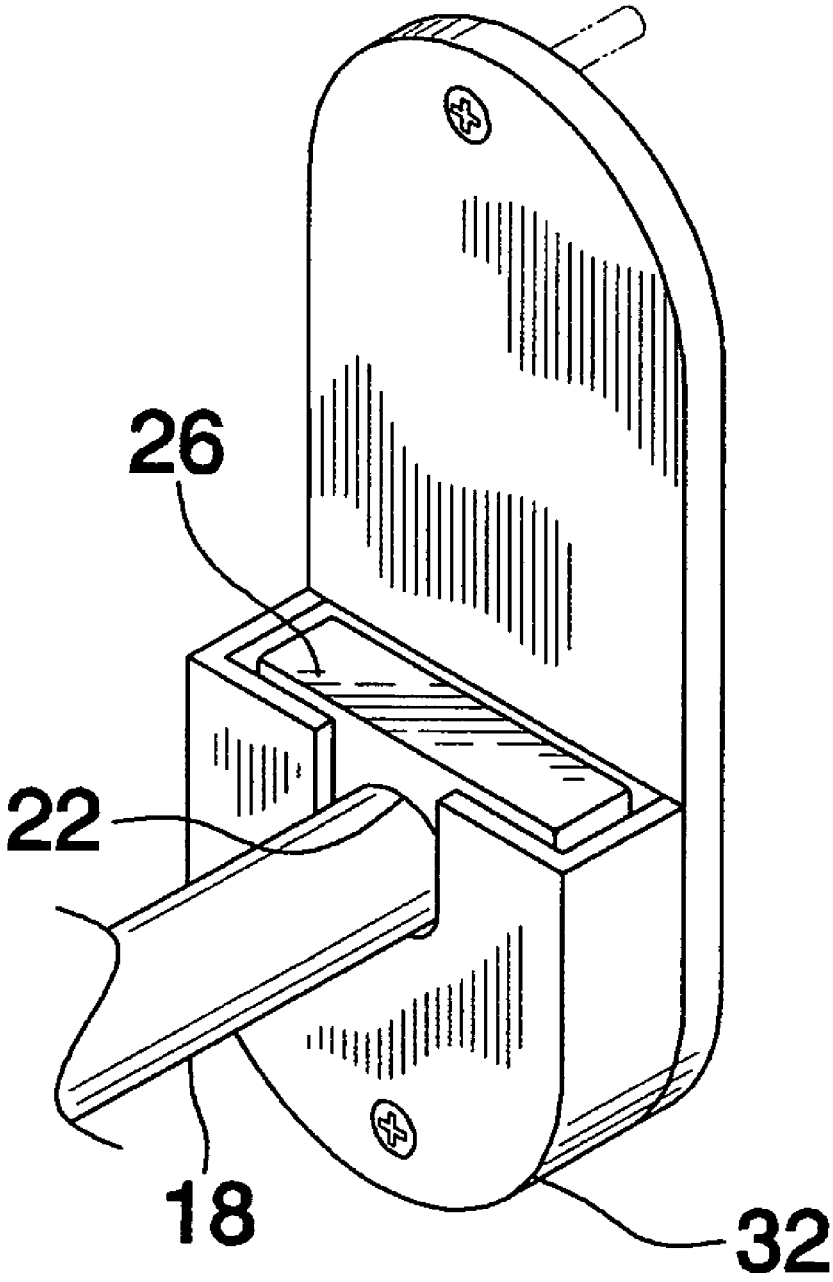
FIG. 5 is a perspective view of the present invention.

With reference now to the drawings, and in particular to FIGS. 1 through 5 thereof, a new bathtub railing device embodying the principles and concepts of the present invention and generally designated by the reference numeral 10 will be described.

As best illustrated in FIGS. 1 through 5, the bathtub railing assembly 10 generally comprises an assembly for a bathtub 5 that is positioned between a first wall 6 and a second wall 7. The first 6 and second 7 walls are positioned oppositely from each other. The bathtub 5 is positioned lengthwise between the first 6 and second 7 walls and abuts each. The assembly 10 includes a bracket 12 is attached to the first wall 6. The bracket 12 is positioned over and adjacent to the bathtub 5, and more preferably adjacent and over a corner of bathtub 5. The bracket 12 includes a rigid panel 14 secured to the first wall with conventional fasteners 16.

An elongated rod 18 is provided that has a first end 20 and a second end 22. The rod 18 is substantially rigid and the first end 20 is pivotally coupled to the bracket 12 so that the rod 18 may be selectively positioned in a vertical position or a horizontal position. The rod 18 has a length, typically between 5 feet and 8 feet, so that the second end 22 of the rod 18 is positioned adjacent to the second wall 7 when the rod 18 is in the horizontal position. The first end 20 is positioned between 6 inches and 18 inches above the bathtub 5.

A securing assembly 24 is adapted for releasably securing the second end 22 of the rod 18 to the second wall 7 when the rod 18 is in the horizontal position. The securing assembly 24 includes a plate 26 that has a first side 28 and a second side 30. The second end 22 of the rod 18 is attached to the first side 28 of the plate 26 such that the rod 18 is orientated perpendicular to a plane of the plate 26. A saddle 32 is attached to the second wall 7 with conventional fasteners 16 and is generally aligned with the first end 22 of the rod 18. The saddle 32 is adapted for removably receiving the plate 26. The saddle 32 is positioned for receiving the plate 26 when the rod 18 is in the horizontal position.

A coupler 34 is attached to the first wall 6 for selectively securing the rod 18 in the vertical position. The coupler 34 preferably includes a pair of posts 36 extending outwardly from the first wall. The posts 36 are horizontally aligned with each other and spaced from each other. A catch 38 is pivotally coupled to one of posts 36 so that the catch 38 may be selectively extended between the posts 36. The rod 18 may be positioned between the posts 36 and the catch 38 extended between the posts so that the rod 18 is held between the catch 38 and the first wall 6.

Additionally, a stabilizing arm 40 may be pivotally attached to the bracket 12 above the first end 20 of the rod 18 and extended to and pivotally attached to the rod 18. The arm 40 has break 42 therein with two sections pivotally coupled together so that the arm 40 may be folded up when the rod 18 is in a vertical position and extended to its full length with the rod 18 is in a horizontal position.

In use, the rod 18 and bracket 12 are attached to the first wall 6 and the saddle 32 is attached to the second wall 7. When a person wishes to use the rod as a railing, the rod 18 is positioned in the horizontal position so that the plate 26 is extended into the saddle 32. The rod's 18 position places it along an outer side edge of the bathtub 5. The saddle 32 provides additional stability for the rod 18. When not in use, the rod 18 is placed in a vertical position and secured in that position with the coupler 34.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A railing system, said system comprising:

a first wall and a second wall being positioned oppositely from each other, a bathtub extending between the first and second walls;

a bracket being attached to the first wall, said bracket being positioned over and adjacent to the bathtub;

an elongated rod having a first end and a second end, said first end being pivotally coupled to said bracket such that said rod may be selectively positioned in a vertical position or a horizontal position, wherein said second end of said rod is positioned adjacent to the second wall when said rod is in said horizontal position; and a stabilizing arm being pivotally attached to said bracket above said first end of said rod and extending to and being pivotally attached to said rod, said arm having a break therein to define two sections of said arm, said two sections of said am being pivotally coupled together, said arm being folded up when said rod is in a vertical position and said arm being extended to a full length when said rod is in a horizontal position.

2. The railing system according to claim 1, wherein said first end is positioned generally between 6 inches and 18 inches from the bathtub.

3. The railing system according to claim 1, further including a securing assembly being adapted for releasably securing said first end of said rod to the second wall when said rod is in said horizontal position.

4. The railing system according to claim 3, wherein said securing assembly includes a plate having a first side and a second side, said second end of said rod being attached to said first side of said plate such that said rod is orientated perpendicular to a plane of said plate, a saddle being attached to said second wall, said saddle being adapted for removably receiving said plate, said saddle being positioned for receiving said plate when said rod is in said horizontal position.

5. The railing system according to claim 4, further including a coupler being attached to the first wall for selectively securing said rod in said vertical position.

6. The railing system according to claim 1, further including a coupler being attached to the first wall for selectively securing said rod in said vertical position.

7. A railing system, said system comprising:

a first wall and a second wall being positioned oppositely from each other, a bathtub extending between the first and second walls;

a bracket being attached to the first wall, said bracket being positioned over and adjacent to the bathtub;

an elongated rod having a first end and a second end, said first end being pivotally coupled to said bracket such that said rod may be selectively positioned in a vertical position or a horizontal position, wherein said second end of said rod is positioned adjacent to the second wall when said rod is in said horizontal position, said first end being positioned between 6 inches and 18 inches from the bathtub;

a securing assembly being adapted for releasably securing said first end of said rod to the second wall when said rod is in said horizontal position, said securing assembly including a plate having a first side and a second side, said second end of said rod being attached to said first side of said plate such that said rod is orientated perpendicular to a plane of said plate, a saddle being attached to said second wall, said saddle being adapted for removably receiving said plate, said saddle being positioned for receiving said plate when said rod is in said horizontal position; and a coupler being attached to the first wall for selectively securing said rod in said vertical position; an a stabilizing arm being pivotally attached to said bracket above said first end of said rod and extending to and being pivotally attached to said rod, said arm having a break therein to define two sections of said arm, said two sections of said arm being pivotally coupled together, said arm being folded up when said rod is in a vertical position and said arm being extended to a full length when said rod is in a horizontal position.

* * * * *